US007715568B2

(12) United States Patent
Nakano

(10) Patent No.: US 7,715,568 B2
(45) Date of Patent: May 11, 2010

(54) BINAURAL SOUND REPRODUCTION APPARATUS AND METHOD, AND RECORDING MEDIUM

(75) Inventor: Kenji Nakano, Kanagawa (JP)

(73) Assignee: Sony Corporation (JP)

( * ) Notice: Subject to any disclaimer, the term of this patent is extended or adjusted under 35 U.S.C. 154(b) by 1308 days.

(21) Appl. No.: 11/105,701

(22) Filed: Apr. 13, 2005

(65) Prior Publication Data

US 2005/0238176 A1 Oct. 27, 2005

(30) Foreign Application Priority Data

Apr. 27, 2004 (JP) ..... P2004-131067

(51) Int. Cl.
*H04R 5/00* (2006.01)

(52) U.S. Cl. ..... 381/17; 381/26; 381/309

(58) Field of Classification Search ..... 381/1, 381/17, 310, 300, 309
See application file for complete search history.

(56) References Cited

U.S. PATENT DOCUMENTS 5,761,314 A * 6/1998 Inanaga et al. ..... 381/17

FOREIGN PATENT DOCUMENTS

JP 09-185383 A 7/1997
JP 11-127500 A 5/1999
JP 11-167383 A 6/1999
JP 2001-285998 A 10/2001
JP 2002-095098 A 3/2002

* cited by examiner

*Primary Examiner*—Vivian Chin
*Assistant Examiner*—Con P Tran
(74) *Attorney, Agent, or Firm*—Lerner, David, Littenberg, Krumholz & Mentlik, LLP

(57) ABSTRACT

A binaural sound reproduction apparatus includes a correction filter operable to filter an input sound signal that is recorded using a binaural recording microphone and to supply the filtered signal to a headphone, an adaptive filter to which the input sound signal is supplied, and a difference detector determining a difference between a sound signal that is obtained by collecting a sound reproduced by the headphone using a sound-collecting microphone that is the same as the binaural recording microphone, or that has a similar characteristic to that of the binaural recording microphone, and a sound signal output from the adaptive filter, and for transmitting the difference to the adaptive filter. The adaptive filter determines the inverse of a synthesis characteristic from the headphone to the sound-collecting microphone based on the input sound signal and the difference, and sets the determined characteristic as a characteristic of the correction filter.

5 Claims, 5 Drawing Sheets

BINAURAL SOUND REPRODUCTION APPARATUS AND METHOD, AND RECORDING MEDIUM

CROSS REFERENCES TO RELATED APPLICATIONS

The present invention contains subject matter related to Japanese Patent Application JP 2004-131067 filed in the Japanese Patent Office on Apr. 27, 2004, the entire contents of which are incorporated herein by reference.

BACKGROUND OF THE INVENTION

1. Field of the Invention

The present invention relates to the field of audio signal processing, specifically, to a binaural sound reproduction apparatus and method.

2. Description of the Related Art

One known method for recording sound from sound sources placed in an acoustic space with maintaining information about the direction of incoming sound and reproducing the sound is a binaural method.

In the binaural method, sound signals recorded by a stereo recording method for recording sound using small microphones around or in the right and left ear canals, in principle, these microphones, are reproduced by a headphone or the like with high fidelity in the ear canals around or in which the microphones are placed. The binaural method allows high-fidelity reproduction of a sound field in the recording site. This method can be implemented by a simple sound recording and reproduction apparatus, and is often used in the field of live recording as a convenient stereo acoustic recording and reproduction method.

The most effective binaural experience is real-head recording and reproduction in which a sound recorded in the ear is reproduced in the ear. This method provides good matching of the so-called head-related transfer function (HRTF), and allows for natural tone (or optimum frequency-amplitude characteristics), optimum sound image localization, high sound image quality, etc.

Japanese Unexamined Patent Application Publication No. 6-217400 discloses a binaural sound recording and reproducing method that allows a listener to receive a reverberant sound in the sound-collecting system in three-dimensional perception of sound while localizing a sound source with natural tone in front of the listener.

SUMMARY OF THE INVENTION

The real-head recording and reproduction seems to be ideal, but may be actually ineffective in that natural tone reproduction is not achieved, sound is reproduced with a diffuse sound image, sound is unclearly localized, etc.

These problems arise because the implicit requirements of binaural sound recording and reproduction, that is, flat and equal transfer characteristics from the recording system to the reproduction system in the right and left channels, are not met. Specifically, the characteristic of the microphone used for recording sound is not flat, the characteristics of the right and left microphones differ from each other, the characteristic of the headphone used for reproducing sound is not flat, or the characteristics of the right and left acoustic converters in the headphone differ from each other, thus reducing the binaural effects.

For example, up and down localization and front and back localization of a sound image are caused by tone to some extent. The difference in level and time (including phase) between the right ear and the left ear greatly affects right and left localization.

Actually, this problem is not straightforward because, for example, the transfer characteristic to the ear often changes if a user takes off a headphone and puts on the same headphone again. In particular, large circumaural headphones, such as closed headphones, have more play, and therefore suffer changes in the transfer characteristic during listening. Generally, inexpensive headphones do not have uniform characteristics in the right and left channels. Generally, inexpensive microphones do not have uniform characteristics and sensitivity.

It is therefore desirable to improve the binaural effects even if the transfer characteristic from the recording system to the reproduction system in real-head recording and reproduction is not flat and the transfer characteristics of the right and left channels differ from each other.

According to an embodiment of the present invention, there is provided a binaural sound reproduction apparatus including a correction filter operable to filter an input sound signal that is recorded using a binaural recording microphone and to supply the filtered signal to a headphone, an adaptive filter to which the input sound signal is supplied, and difference detecting means for determining a difference between a sound signal that is obtained by collecting a sound reproduced by the headphone using a sound-collecting microphone that is the same as the binaural recording microphone or that has a similar characteristic to that of the binaural recording microphone and a sound signal output from the adaptive filter, and for transmitting the difference to the adaptive filter. The adaptive filter determines the inverse of a synthesis characteristic from the headphone to the sound-collecting microphone based on the input sound signal and the difference, and sets the determined characteristic as a characteristic of the correction filter.

A user wears a microphone used for binaural recording or a microphone whose characteristic is similar to that of the microphone used for binaural recording in the user's ear in a similar manner to that during recording, and also wears a headphone. When an acoustic measurement signal, such as an impulse, is reproduced from the headphone and is collected by the microphone, the characteristic of the signal from the microphone is a characteristic in which the characteristic of the headphone, the acoustic transfer characteristic (spatial transfer characteristic) from the headphone position to the microphone position, and the characteristic of the microphone are synthesized.

The characteristic that is similar to the synthesis characteristic and that is the inverse of the synthesis characteristic (hereinafter referred to as an "inverse synthesis characteristic") is determined. The inverse synthesis characteristic may be used to correct for the characteristic of the headphone, the acoustic transfer characteristic from the headphone position to the microphone position, and the characteristic of the microphone.

Specifically, a correction filter superimposes the inverse synthesis characteristic onto a binaural signal recorded by a recording microphone. The binaural signal has originally the characteristic of the recording microphone superimposed thereon. Since the inverse synthesis characteristic includes the inverse of the characteristic of the recording microphone, the characteristic of the recording microphone superimposed on the binaural signal is corrected for to produce the same binaural signal as that recorded by a microphone whose characteristic is flat.

The inverse synthesis characteristic also includes the inverse of the characteristic of the headphone, and a signal to be reproduced by a headphone whose characteristic is flat is therefore obtained as the reproduction signal.

The inverse synthesis characteristic also includes the inverse of the acoustic transfer characteristic from the headphone to the microphone, and therefore sound is transmitted from the headphone to the microphone with a flat transfer characteristic. Thus, the spatial transfer characteristic that depends upon the individual ear shape when a circumaural headphone is used can be corrected for.

In the binaural sound reproduction apparatus, therefore, the correction filter superimposes the inverse synthesis characteristic onto a binaural signal obtained by the recording microphone to produce the optimum binaural reproduction signal even if a microphone and a headphone that do not exhibit a flat characteristic or uniform characteristics in the right and left channels are used.

The recording microphone and the sound-collecting microphone (which is a microphone used for reproducing sound) are not necessarily the same as long as these microphones have similar characteristics.

The user who binaurally records material and the user who binaurally reproduces sound (or the listener) are not necessarily the same. It is ideal that these users be the same, otherwise, as long as the characteristics of the microphone and the headphone are corrected for in the manner described above, the binaural effects can be improved.

Furthermore, an ordinary sound signal used as a binaural signal may be reproduced without using a special acoustic measurement signal such as an impulse. The adaptive filter determines the inverse of a synthesis characteristic from the headphone position to the microphone position, and the correction filter superimposes the inverse synthesis characteristic onto the ordinary sound signal used as a binaural signal. Thus, the characteristics of the microphone and the headphone can be corrected for.

Therefore, binaural sound reproduction can be achieved with little burden on the listener. Moreover, the characteristic of the correction filter can sequentially be updated. A change in characteristics due to the movement of the headphone worn by the listener during reproduction and listening can be dealt with.

Accordingly, the binaural effects can be improved even if the transfer characteristic from the recording system to the reproduction system in real-head recording and reproduction is not flat and the transfer characteristics of the right and left channels differ from each other. Furthermore, the binaural effects can be improved without using a special acoustic measurement signal. Moreover, a change in characteristics due to the movement of the headphone worn by the listener during reproduction and listening can be dealt with.

DESCRIPTION OF THE PREFERRED EMBODIMENTS

Figure 1:
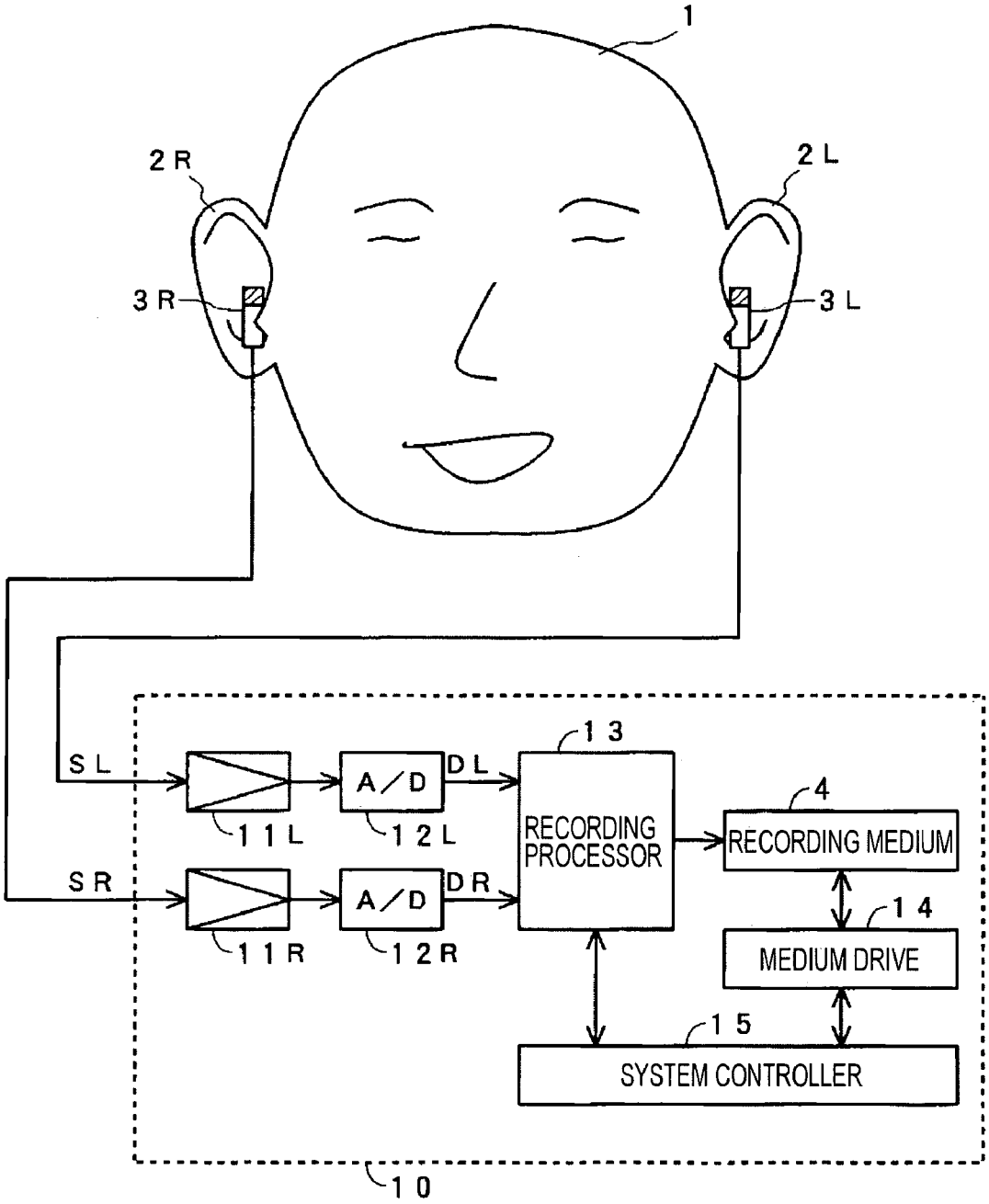
FIG. 1 is a diagram of a binaural recording mechanism.

A binaural recording method prior to a binaural sound reproduction method according to an embodiment of the present invention will now be described with FIG. 1.

In this binaural sound recording method, in a recording site, a user 1 wears small recording microphones 3L and 3R around or in the left ear canal 2L and the right ear canal 2R, and the microphones 3L and 3R are used to stereo record sound from sound sources in the acoustic space in the recording site.

The recording microphones 3L and 3R are not necessarily the same as microphones used for reproducing sound as long as the characteristics of the microphones 3L and 3R are similar to those of microphones used for reproducing sound, described below. The user 1 (who binaurally records material) may not be a listener (who binaurally reproduces the material). For example, an artificial head or simulated head that simulates the human head may be used.

Sound signals SL and SR are input as binaural signals to a recording device 10 from the microphones 3L and 3R, and are then recorded in a recording medium 4, such as a disk medium or a memory card.

Specifically, in the recording device 10, the input sound signals SL and SR are amplified by sound amplification circuits 11L and 11R, respectively, and are then converted into digital sound data DL and DR by analog-to-digital (AD) converters 12L and 12R, respectively. The resulting digital sound data DL and DR are input to a recording processor 13, and are then recorded in the recording medium as sound data having a predetermined format after they are compressed and encoded, if necessary.

In the recording device 10, a system controller 15 controls the recording processor 13 and a medium drive 14.

Accordingly, the sound reaching the human ear or the ear of the artificial head is recorded in the recording site. The right-channel sound and the left-channel sound in the right and left ear canals or at the microphones 3R and 3L are recorded with the difference in level, time, and characteristics depending upon the positional or directional relationship between the microphones 3R and 3L and the sound sources.

In order to reproduce the binaural signals recorded in the manner described above, as shown in FIG. 2, a listener 5 wears microphones 7R and 7L around the right and left ear canals 6R and 6L, respectively, and also wears a headphone 9.

The microphones 7L and 7R are small and are not circumaural. Preferably, the microphones 7L and 7R are the same as the recording microphones 3L and 3R shown in FIG. 1, but may be different from the microphones 3L and 3R as long as the characteristics of the microphones 7L and 7R are similar to those of the microphones 3L and 3R.

Figure 2:
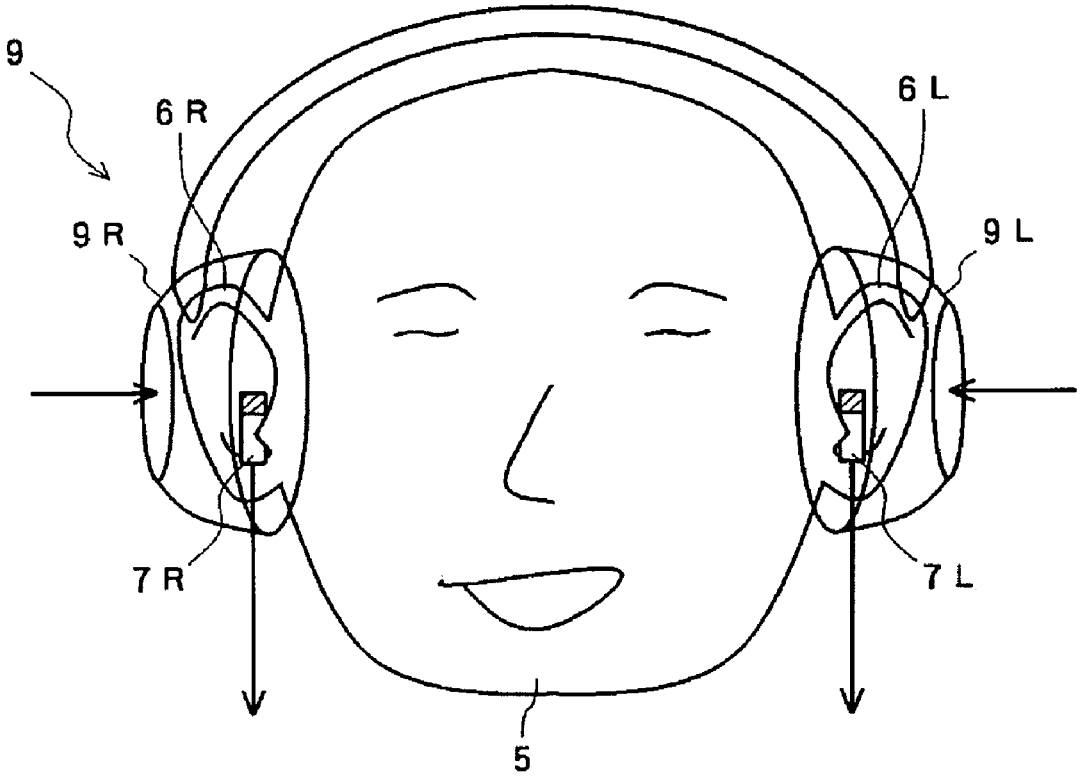
FIG. 2 is an illustration of a listener who wears a microphone and a headphone during binaural sound reproduction.

As shown in FIG. 2, the headphone 9 may be of the circumaural type that a right-channel acoustic converter 9R and a left-channel acoustic converter 9L covers the right and left ears 6R and 6L of the listener 5, respectively. Alternatively, the headphone 9 may be an open headphone or a semi-open headphone.

Figure 3:
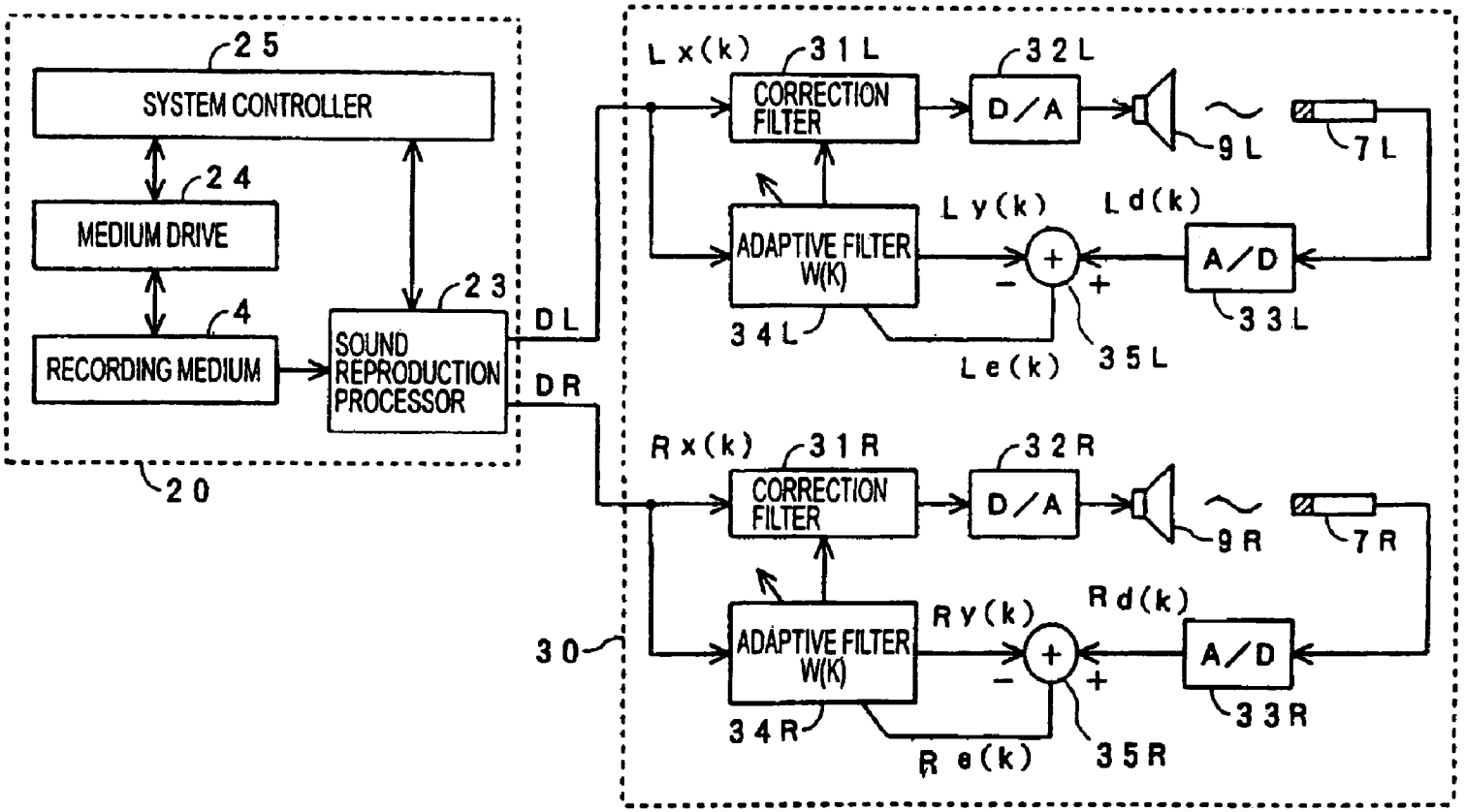
FIG. 3 is a block diagram of a binaural sound reproduction apparatus according to an embodiment of the present invention.

FIG. 3 shows a binaural sound reproduction mechanism allowing the listener 5 to reproduce the binaural signals recorded in the manner described above using the microphones 7L and 7R and the headphone 9.

In a sound reproduction apparatus 20, the recorded binaural signals are read from the recording medium 4. The read binaural signals are subjected to processing, such as extension and decoding, if necessary, by a sound reproduction processor 23, and digital sound data DL and DR, which are binaural signals, are output from the sound reproduction processor 23.

In the sound reproduction apparatus 20, a media drive 24 and the sound reproduction processor 23 are controlled by a system controller 25.

The sound data DL and DR output from the sound reproduction processor 23 of the sound reproduction apparatus 20 are supplied to a binaural sound reproduction apparatus 30.

The binaural sound reproduction apparatus 30 is composed of a left-channel system and a right-channel system. The sound data DL is supplied to the left-channel system, and the sound data DR is supplied to the right-channel system.

In the left-channel system, the sound data DL is supplied as input sound data Lx(k) to a correction filter 31L and an adaptive filter 34L. The sound data output from the correction filter 31L is converted by a digital-to-analog (DA) converter 32L into an analog sound signal, and the resulting sound signal is supplied to the left-channel headphone acoustic converter 9L. Thus, the left-channel sound is reproduced.

The reproduced left-channel sound is collected using a microphone 7L near a left-channel headphone acoustic converter 9L. The sound signal output from the microphone 7L is converted by an AD converter 33L into digital sound data Ld(k). An adder circuit 35L subtracts sound data Ly(k) output from the adaptive filter 34L from the sound data Ld(k) output from the AD converter 33L, and difference data Le(k) output from the adder circuit 35L is transmitted to the adaptive filter 34L.

The adaptive filter 34L is composed of a finite impulse response (FIR) filter type adaptive linear coupler (filter unit) and an adaptive algorithm computation unit (filter coefficient update computation unit). The adaptive filter 34L is operable to estimate a transfer characteristic, in which the characteristic of the correction filter 31L, the characteristic of the left-channel headphone acoustic converter 9L, the spatial transfer characteristic (acoustic transfer characteristic) from the left-channel headphone acoustic converter 9L to the microphone 7L, and the characteristic of the microphone 7L are synthesized, according to an adaptive algorithm (filter coefficient updating algorithm) described below. If the characteristic of the correction filter 31L is flat, the adaptive filter 34L estimates a transfer characteristic, in which the characteristic of the left-channel headphone acoustic converter 9L, the spatial transfer characteristic from the left-channel headphone acoustic converter 9L to the microphone 7L, and the characteristic of the microphone 7L are synthesized.

The correction filter 31L is composed of, for example, an FIR filter. The filter coefficient of the correction filter 31L is modified by the adaptive filter 34L, and the filter characteristic is updated.

The right-channel system includes a right-channel headphone acoustic converter 9R, a microphone 7R, a correction filter 31R, a DA converter 32R, an AD converter 33R, an adaptive filter 34R, and an adder circuit 35R, and processes the input sound data DR.

In ideal estimation performed by the adaptive filter 34L and update of the characteristic of the correction filter 31L, first, the characteristic of the correction filter 31L is made flat, and the adaptive filter 34L estimates a transfer characteristic, in which the characteristic of the left-channel headphone acoustic converter 9L, the spatial transfer characteristic from the left-channel headphone acoustic converter 9L to the microphone 7L, and the characteristic of the microphone 7L are synthesized. Then, the filter coefficient of the correction filter 31L is updated so that the characteristic of the correction filter 31L is the inverse of the transfer characteristic. The characteristic of the adaptive filter 34L is also made a flat, thus achieving estimation by the adaptive filter 34L.

However, actually, a transfer characteristic, in which the characteristic of the left-channel headphone acoustic converter 9L, the spatial transfer characteristic from the left-channel headphone acoustic converter 9L to the microphone 7L, and the characteristic of the microphone 7L are synthesized, may contain, in form of a dip, a frequency region having a low signal level. The inverse of such a transfer characteristic has a frequency region with large gain, and therefore is not suitable for a filter.

Preferably, the characteristic of the correction filter 31L is updated by limiting the signal level within a certain range using a limiter or the like so as not to contain such a large-gain frequency region. A portion that is not reflected in the characteristic of the correction filter 31L remains in the characteristic of the adaptive filter 34L. Thus, the adaptive filter 34L is convergent.

While a case where the characteristic of the correction filter 31L is not updated until the adaptive filter 34L performs estimation and is convergent has been described, the characteristic of the correction filter 31L may be updated at any time before the adaptive filter 34L performs estimation and is convergent.

Figure 4:
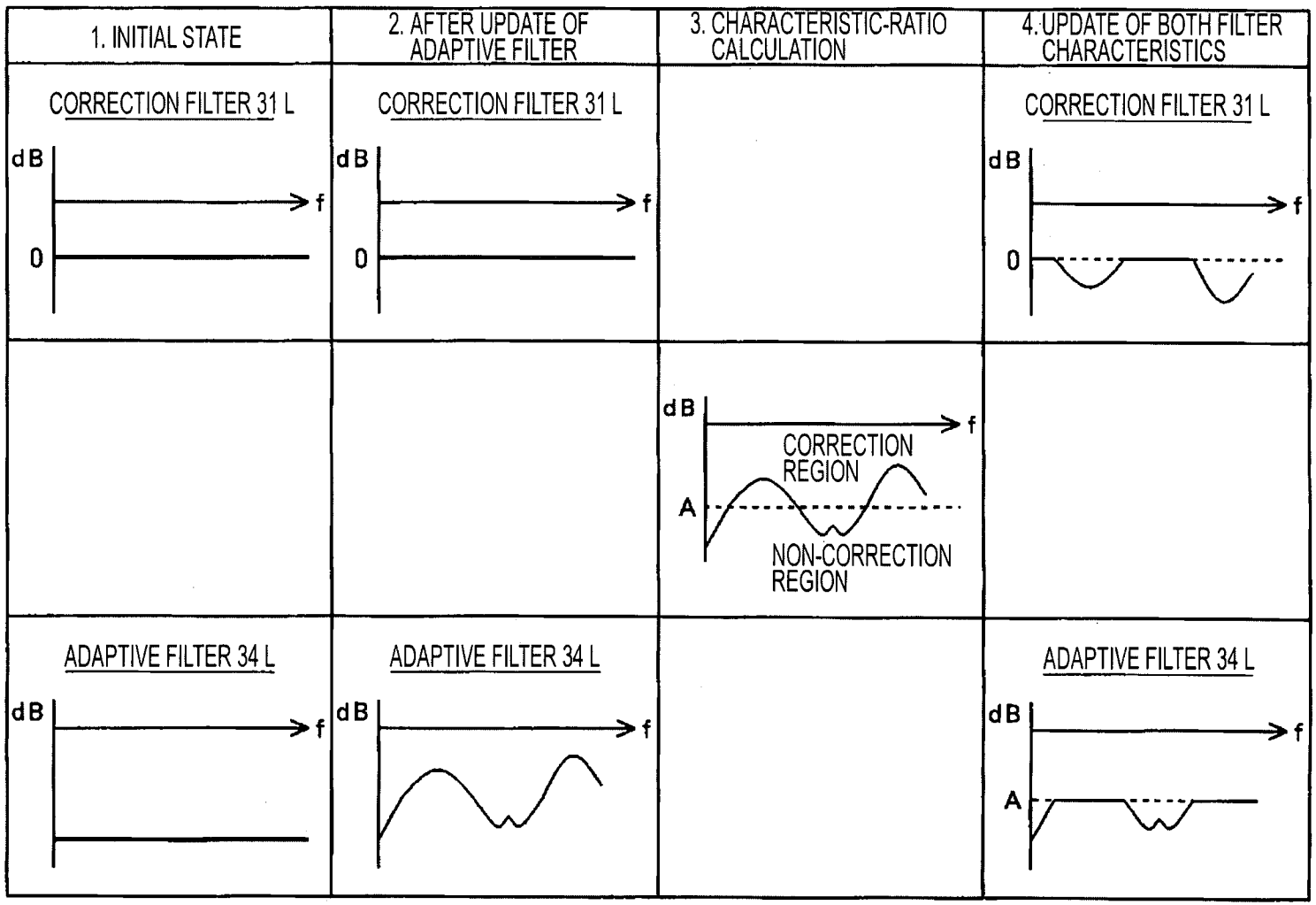
FIG. 4 is an adaptive algorithm for updating the characteristics of a correction filter and an adaptive filter according to an embodiment of the present invention.

FIG. 4 shows an adaptive algorithm for the left-channel system in a case where the characteristic of the correction filter 31L is updated at any time. Although FIG. 4 shows only the level characteristic (in each characteristic chart shown in FIG. 4, the x-axis indicates the frequency (f) and the y-axis indicates the level in decibels (dB)), the estimation and convergence of the adaptive filter 34L and the update of the characteristic of the correction filter 31L are also performed with respect to the phase (including delay) characteristic. This adaptive algorithm also applies to the right-channel system.

When sound reproduction begins, as indicated by the "initial state" shown in FIG. 4, the level characteristic of the correction filter 31L is 0 dB and flat, which means that an input signal is transmitted, and the level characteristic of the adaptive filter 34L is lower. Thus, if the input sound data x(k) constantly contains a low-level frequency region, the adaptive filter 34L can easily perform estimation. Although, in FIG. 4, the level characteristic of the adaptive filter 34L is also flat at the initial state, the level characteristic of the adaptive filter 34L may not be flat.

Then, the coefficient of the adaptive filter 34L is updated to some extent without modifying the correction filter 31L. Thus, as indicated as "after update of adaptive filter" shown in FIG. 4, the level characteristic of the adaptive filter 34L changes. At this stage, the adaptive filter 34L does not complete estimation or convergence.

At this time, the characteristic of the correction filter 31L is updated. As indicated by "characteristic-ratio calculation" shown in FIG. 4, the characteristic ratio of (level characteristic of adaptive filter)/(level characteristic of correction filter) is calculated. Since the level characteristic of the correction filter 31L is 0 dB and flat, the characteristic ratio of (level characteristic of adaptive filter)/(level characteristic of correction filter) is equal to the level characteristic of the adaptive filter 34L.

The resulting characteristic is divided into a non-correction region and a correction region that are bounded at a threshold level of A dB. A frequency region having a level equal to or lower than A dB is referred to as a non-correction region, and a frequency region having a level higher than A dB is referred to as a correction region.

As indicated by "update of both filter characteristics" shown in FIG. 4, the level characteristic of the adaptive filter 34L and the level characteristic of the correction fitter 31L are updated. The level characteristic of the adaptive filter 34L is updated so that, in the non-correction region, the previous level characteristic in this region remains and the level characteristic in the correction region is set to A dB. The level characteristic of the correction filter 31L is updated so that the level in the non-correction region is maintained at 0 dB and the level in the correction region is set to the level obtained by subtracting the level of the characteristic ratio of (level characteristic of adaptive filter)/(level characteristic of correction filter) from A dB.

An operation similar to the operation indicated by "after update of adaptive filter", "characteristic-ratio calculation", and "update of both filter characteristics" is repeatedly performed to form, as the correction filter 31L, a practical correction filter exhibiting a level characteristic whose peak is suppressed, and the adaptive filter 34L is to complete estimation and convergence.

Moreover, the characteristics of the adaptive filter 34L and the correction filter 31L are sequentially updated. If the spatial transfer characteristic from the left-channel headphone acoustic converter 9L to the microphone 7L changes due to the movement of the worn headphone 9 during reproduction and listening, the characteristics of the adaptive filter 34L and the correction filter 31L are also updated, and the adaptive filter 34L completes estimation and convergence.

Figure 5:
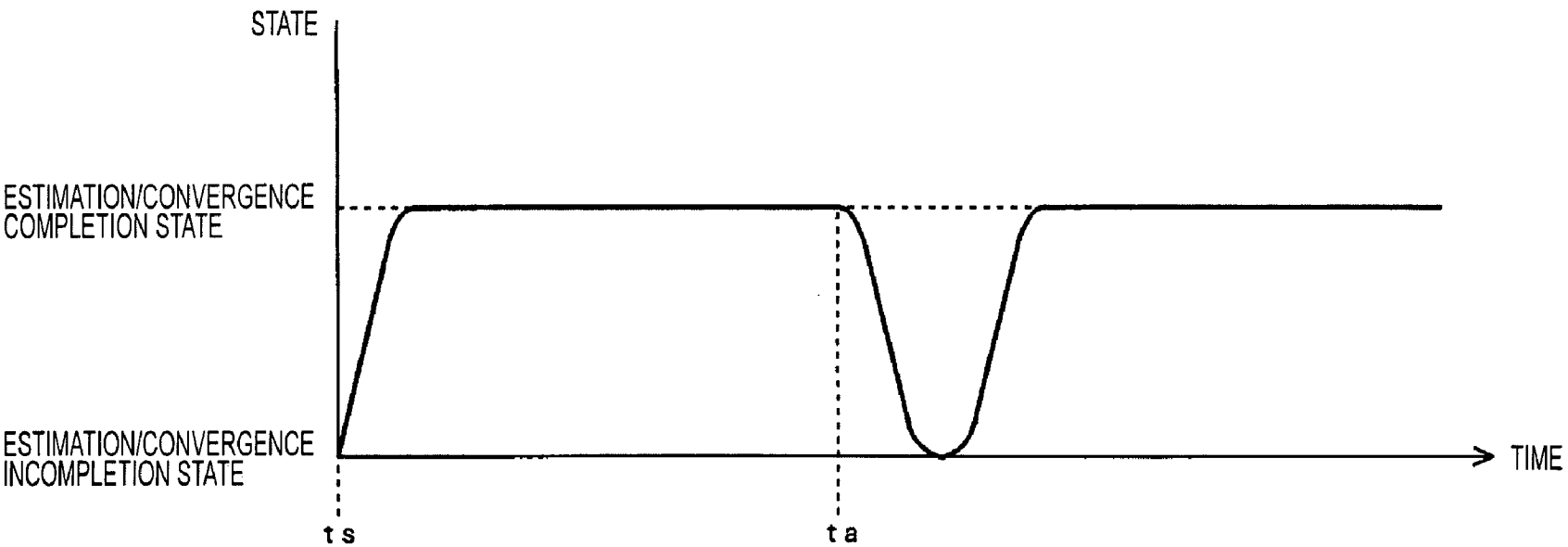
FIG. 5 is a graph showing estimation and convergence of the adaptive filter according to an embodiment of the present invention.

FIG. 5 is a graph showing estimation and convergence of the adaptive filter 34L. Sound reproduction begins at ts. At ts, the adaptive filters 34L and 34R are in an estimation/convergence incompletion state. The update of the characteristics, described above, allows the adaptive filters 34L and 34R to become in an estimation/convergence completion state immediately after ts. At ta, if some disturbance occurs in the binaural sound reproduction system due to, for example, the movement of the worn headphone 9 and, the adaptive filters 34L and 34R are in the estimation/convergence incompletion state for a short period of time. However, after the update of the characteristics, described above, the adaptive filters 34L and 34R are in the estimation/convergence completion state again.

In the example shown in FIG. 4, a threshold level of A dB between the non-correction region and the correction region is fixed. The sound frequency region may be divided into a plurality of frequency sub-regions, and the threshold level between the non-correction region and the correction region may be different in each frequency sub-region, or the threshold level between the non-correction region and the correction region may be changed depending upon the situation, e.g., at the beginning of sound reproduction, during sound reproduction, etc.

Although the binaural sound reproduction apparatus 30 shown in FIG. 3 integrally includes the headphone acoustic converters 9L and 9R and the microphones 7L and 7R, a binaural sound reproduction apparatus including only a signal processor, which is separate from the headphone acoustic converters 9L and 9R and the microphones 7L and 7R, may be used. Therefore, a listener can use an existing headphone in combination with the microphones 7L and 7R and the binaural sound reproduction apparatus including a signal processor to achieve stable binaural sound reproduction.

The signal processing in a binaural sound reproduction apparatus according to an embodiment of the present invention may be implemented by software executed by a digital signal processor (DSP) or a central processing unit (CPU). For example, a headphone worn by a listener can be connected to a standard headphone output terminal of a personal computer (PC), and a microphone around the listener's ear canals can be connected to a standard microphone input terminal of the PC so that the signal processing described above can be executed by the CPU or the like in the PC. The signal processing can be obtained in form of software (program) executable on the PC or the like. Thus, the listener can realize binaural sound reproduction according to an embodiment of the present invention.

It should be understood by those skilled in the art that various modifications, combinations, sub-combinations and alterations may occur depending on design requirements and other factors insofar as they are within the scope of the appended claims or the equivalents thereof.

What is claimed is:

1. A binaural sound reproduction apparatus comprising:

a correction filter to receive an input sound signal that is recorded using a binaural recording microphone and to filter the input sound signal to obtain a filtered signal and to supply the filtered signal to a headphone;

an adaptive filter to receive the input sound signal; and difference detecting means for determining a difference between a sound signal that is obtained by collecting a sound reproduced by the headphone using a sound-collecting microphone that has a similar characteristic to that of the binaural recording microphone and a sound signal output from the adaptive filter and for feeding the difference to the adaptive filter, based on the input sound signal and the difference the adaptive filter is able to obtain a synthesis characteristic representative of (i) a characteristic of the headphone, (ii) a characteristic from the headphone to the sound-collecting microphone, and (iii) a characteristic of the sound-collecting microphone, to invert the synthesis characteristic so as to obtain an inverse synthesis characteristic, and to set a characteristic of the correction filter in accordance with the inverse synthesis characteristic, the set characteristic of the correction filter has a non-correction region and a correction region, in which the non-correction region includes a frequency region having an amplitude level or levels equal to or lower than a predetermined level and the correction region includes a frequency region having an amplitude level or levels higher than the predetermined level.

2. The apparatus according to claim 1, wherein the sound-collecting microphone is placed around an ear canal of a listener who wears the headphone.

3. A binaural sound reproduction method comprising the steps of:

supplying an input sound signal recorded using a binaural recording microphone to a headphone via a correction filter and to an adaptive filter;

obtaining a sound signal by collecting a sound reproduced by the headphone using a sound-collecting microphone that has a similar characteristic to that of the binaural recording microphone;

transmitting a difference between the sound signal from the sound-collecting microphone and a sound signal output from the adaptive filter to the adaptive filter;

obtaining a synthesis characteristic based on the input sound signal and the difference representative of (i) a characteristic of the headphone, (ii) a characteristic from the headphone to the sound-collecting microphone, and (iii) a characteristic of the sound-collecting microphone;

inverting the synthesis characteristic so as to obtain an inverse synthesis characteristic; and setting a characteristic of the correction filter in accordance with the inverse synthesis characteristic, in which the set characteristic of the correction filter has a non-correction region and a correction region, in which the non-correction region includes a frequency region having an amplitude level or levels equal to or lower than a predetermined level and the correction region includes a frequency region having an amplitude level or levels higher than the predetermined level.

4. A recording medium recording a program to be executed by a computer, the program comprising the steps of:

supplying a binaural sound signal to a headphone via a correction filter;

obtaining a microphone signal by collecting a sound reproduced by the headphone using a sound-collecting microphone that has a similar characteristic to that of the binaural recording microphone;

supplying the binaural sound signal to an adaptive filter;

transmitting a difference between the microphone signal and a sound signal output from the adaptive filter to the adaptive filter;

obtaining a synthesis characteristic based on the input sound signal and the difference representative of (i) a characteristic of the headphone, (ii) a characteristic from the headphone to the sound-collecting microphone, and (iii) a characteristic of the sound-collecting microphone;

inverting the synthesis characteristic so as to obtain an inverse synthesis characteristic; and setting a characteristic of the correction filter in accordance with the inverse synthesis characteristic, in which the set characteristic of the correction filter has a non-correction region and a correction region, in which the non-correction region includes a frequency region having an amplitude level or levels equal to or lower than a predetermined level and the correction region includes a frequency region having an amplitude level or levels higher than the predetermined level.

5. A binaural sound reproduction apparatus comprising:

a correction filter to receive an input sound signal that is recorded using a binaural recording microphone and to filter the input sound signal to obtain a filtered signal and to supply the filtered signal to a headphone;

an adaptive filter to receive the input sound signal; and a difference detector determining a difference between a sound signal that is obtained by collecting a sound reproduced by the headphone using a sound-collecting microphone that has a similar characteristic to that of the binaural recording microphone and a sound signal output from the adaptive filter and for feeding the difference to the adaptive filter, based on the input sound signal and the difference the adaptive filter is able to obtain a synthesis characteristics representative of (i) a characteristic of the headphone, (ii) a characteristic from the headphone to the sound-collecting microphone, and (iii) a characteristic of the sound-collecting microphone, to invert the synthesis characteristic so as to obtain an inverse synthesis characteristic, and to set a characteristic of the correction filter in accordance with the inverse synthesis characteristic, the set characteristic of the correction filter has a non-correction region and a correction region, in which the non-correction region includes a frequency region having an amplitude level or levels equal to or tower than a predetermined level and the correction region includes a frequency region having an amplitude level or levels higher than the predetermined level.

* * * * *